US010563665B2

(12) United States Patent
Rice

(10) Patent No.: US 10,563,665 B2
(45) Date of Patent: Feb. 18, 2020

(54) TURBOMACHINE STAGE AND METHOD OF MAKING SAME

(71) Applicant: Rolls-Royce North American Technologies, Inc., Indianapolis, IN (US)

(72) Inventor: Edward C. Rice, Indianapolis, IN (US)

(73) Assignee: ROLLS-ROYCE NORTH AMERICAN TECHNOLOGIES, INC., Indianapolis, IN (US)

( * ) Notice: Subject to any disclaimer, the term of this patent is extended or adjusted under 35 U.S.C. 154(b) by 520 days.

(21) Appl. No.: 15/419,990

(22) Filed: Jan. 30, 2017

(65) Prior Publication Data

US 2018/0216628 A1 Aug. 2, 2018

(51) Int. Cl.

| | |
|---|---|
| ***F04D 29/32*** | (2006.01) |
| ***F04D 29/28*** | (2006.01) |
| ***F04D 29/30*** | (2006.01) |
| ***F04D 29/02*** | (2006.01) |
| ***F04D 29/38*** | (2006.01) |

(Continued)

(52) U.S. Cl.

CPC ..... *F04D 29/322* (2013.01); *F01D 5/30* (2013.01); *F01D 5/3061* (2013.01); *F01D 5/3069* (2013.01); *F01D 5/34* (2013.01); *F04D 29/023* (2013.01); *F04D 29/281* (2013.01); *F04D 29/284* (2013.01); *F04D 29/30* (2013.01); *F04D 29/324* (2013.01); *F04D 29/388* (2013.01); *F04D 29/624* (2013.01);

(Continued)

(58) Field of Classification Search

CPC ..... F01D 5/30; F01D 5/3069; F01D 5/3061; F01D 5/3015; F01D 5/3007; F01D 5/34; F04D 29/023; F04D 29/281; F04D 29/284; F04D 29/322; F04D 29/324; F04D 29/388; F04D 29/624; F04D 29/628; F04D 29/648; F16B 5/0012; F16B 13/025

See application file for complete search history.

(56) References Cited

U.S. PATENT DOCUMENTS 1,510,146 A * 9/1924 Johnson ..... F01D 5/30 228/173.6

4,270,256 A 6/1981 Ewing (Continued)

FOREIGN PATENT DOCUMENTS

DE 102009052783 A1 5/2011
EP 0303535 B1 3/1992

(Continued)

OTHER PUBLICATIONS

European Patent Office, Extended European Search Report, European Application No. 15194059.9-1610, dated Apr. 25, 2016, 10pgs.

*Primary Examiner* — David E Sosnowski
*Assistant Examiner* — Brian P Wolcott
(74) *Attorney, Agent, or Firm* — Duane Morris LLP

(57) ABSTRACT

A turbomachine comprises a hub and a plurality of blade elements. Each blade element comprises a blade, a platform, and a tang. The plurality of blade elements are arranged circumferentially around the hub, each interlocking or affixed with an adjacent blade element and retained in position by the hub. Each blade elements formed from a single stamped blank to provide an inexpensive method of manufacture, for low cost turbomachinery.

20 Claims, 11 Drawing Sheets

(51) Int. Cl.

| | |
|---|---|
| ***F04D 29/62*** | (2006.01) |
| ***F04D 29/64*** | (2006.01) |
| ***F01D 5/30*** | (2006.01) |
| ***F01D 5/34*** | (2006.01) |

(52) U.S. Cl.
CPC ..... *F04D 29/644* (2013.01); *F04D 29/628* (2013.01); *F04D 29/648* (2013.01)

(56) References Cited

U.S. PATENT DOCUMENTS

| | | | | |
|---|---|---|---|---|
| 4,494,287 | A | 1/1985 | Cruzen et al. | |
| 4,595,340 | A | 6/1986 | Klassen et al. | |
| 5,022,822 | A | 6/1991 | Sincere | |
| 5,263,823 | A | 11/1993 | Cabaret et al. | |
| 5,425,622 | A | 6/1995 | Murray | |
| 5,536,145 | A | 7/1996 | Vandendriessche | |
| 6,164,917 | A | 12/2000 | Frasier et al. | |
| 6,196,794 | B1 * | 3/2001 | Matsumoto ..... | B29C 65/5042 415/191 |
| 7,784,182 | B2 | 8/2010 | Carrier et al. | |
| 7,832,986 | B2 | 11/2010 | Baker et al. | |
| 7,971,334 | B2 | 7/2011 | Walsh et al. | |
| 8,123,487 | B2 | 2/2012 | Bayer et al. | |
| 8,206,117 | B2 | 6/2012 | Strangman et al. | |
| 8,282,355 | B2 | 10/2012 | Blanchard et al. | |
| 8,348,619 | B2 | 1/2013 | Derclaye et al. | |
| 8,408,874 | B2 | 4/2013 | McCaffrey et al. | |
| 8,753,090 | B2 | 6/2014 | Basiletti et al. | |
| 8,764,388 | B2 | 7/2014 | Roberts et al. | |
| 8,888,459 | B2 * | 11/2014 | Noble ..... | F01D 5/22 416/193 A |
| 9,033,673 | B2 * | 5/2015 | Roussille ..... | F01D 5/147 416/229 A |
| 2010/0150725 | A1 | 6/2010 | Krautheim | |
| 2012/0003103 | A1 | 1/2012 | Tholath | |
| 2012/0315164 | A1 | 12/2012 | Mayernick et al. | |
| 2013/0064667 | A1 | 3/2013 | Campbell et al. | |
| 2013/0156590 | A1 | 6/2013 | Blanchard et al. | |
| 2013/0243601 | A1 | 9/2013 | Floyd | |
| 2015/0345296 | A1 | 12/2015 | Davidson et al. | |
| 2015/0354374 | A1 | 12/2015 | Hofer et al. | |
| 2016/0130957 | A1 | 5/2016 | Freeman et al. | |

FOREIGN PATENT DOCUMENTS

| | | | | |
|---|---|---|---|---|
| FR | 885038 A | * | 9/1943 | ..... F01D 5/30 |
| GB | 2050528 A | | 1/1981 | |

* cited by examiner

TURBOMACHINE STAGE AND METHOD OF MAKING SAME

FIELD OF THE DISCLOSURE

The present disclosure relates generally to turbomachinery, and more specifically to low cost compressor or turbine stages constructed with blades fabricated by stamping and retained in position at least by a disc for use in axial-flow and centrifugal fluid compressors as well as other turbomachinery.

BACKGROUND

Turbomachines such as compressors and turbines are used in a variety of applications to either (1) compress a fluid from an inlet pressure to a discharge pressure which is higher than inlet pressure or (2) expand a fluid from an inlet pressure to a discharge pressure that is lower than the respective inlet pressure while extracting work. Turbomachines typically comprise a rotatable element of a plurality of blades mounted to a rotor and a static element of a plurality of vanes mounted to a casing.

Applications of turbomachines include gas turbine engines, where a compressor supplies high pressure air to a combustor while a turbine expands the heated fluid to extract work. The rotor of the compressor/turbine may be coupled to at least a portion of the rotor of the turbine component in the gas turbine engine. In aviation applications such as a compressor used in an engine for an aircraft, missile, or other airborne element, the cost of the compressor can significantly affect its compatibility or applicability for certain markets.

The growth and capabilities of the expendable gas turbine market will depend on low cost alternatives to today's accepted manufacturing technology. The emerging markets for expendable gas turbine engines for the missile/drone market do not require long life. They do, however, favor low cost and this desire to reduce costs may offset any reduced aerodynamic efficiency encountered.

Typically, compressor or turbine stages are fabricated by machining disks (wheels) and blades that are assembled into a single unit. As designs evolved, compressor stage blisks (integral blades and disk) are being fabricated by machining a single block of material. These two methods generally provide a turbine stage having good aerodynamic characteristics over a long service life and with low risk associated with the configuration. However, these methods also carry a high economic price.

It is thus desired for an improvement in the art of fabricating turbomachinery components, and particularly compressors, to provide less expensive alternative to current fabrication of turbomachinery.

SUMMARY

According to an aspect of the present disclosure, a turbomachine comprises a hub comprised of a fore wheel and an opposing aft wheel, the fore and aft wheels being co-axial, the hub having a bore coaxial with the wheels and a blade nesting surface; and a plurality of blade elements. Each one of the plurality of blades elements is formed from a stamped blank and comprises a blade section; a tang section; and a platform section connecting the blade section at a first end of the platform section and the tang section at a second end of the platform section, wherein the first and second ends of the platform transitions into the blade and the tang sections respectively. In some embodiments the plurality of blade elements are arranged circumferentially around the hub, each of the platforms of the respective blade elements overlapping the tang section of an adjacent blade element and retained in position between the fore and aft wheel by the engagement with the fore and aft wheel and attachment with the adjacent blade, wherein each blade element abuts the blade nesting surface of the hub.

In some embodiments the turbomachine is an axial compressor. In some embodiments the fore wheel abuts the aft wheel on opposing inner faces. In some embodiments the tang sections of each of the plurality of blade elements extend axially beyond the platform section and are received in co-axial slots on opposing outer faces of the respective wheels.

In some embodiments the blade nesting surface is normal to the radial direction. In some embodiments the hub has a shape from the group consisting of cone, conical frustum, cylinder, zone, paraboloid, hyperboloid and semi-spheroid. In some embodiments the turbomachine further comprises a slot and a tab, the slot in the platform section proximate the second end for receiving a corresponding tab on an adjacent platform section proximate the first end of the adjacent blade element.

In some embodiments a second tang section extends axially forward and aft from an overlapping portion of the blade platform proximate the second end. In some embodiments the plurality of blade elements are stamped from a sheet of metal or metal alloy. In some embodiments the attachment with the adjacent blade is selected from the group comprising an interlock, an adhesive bond, a weld, and a braze.

In some embodiments the sheet is a sheet of high carbon steel or nickel alloy. In some embodiments the turbomachine is a centrifugal compressor. In some embodiments the blade nesting surface is normal to the axial direction. In some embodiments the aft wheel is a disc and the fore wheel is a spindle.

According to another aspect of the present disclosure, a method of manufacturing a bladed hub of a turbomachine comprises blanking blanks from a sheet of metal or metal alloy; bending the blanks to form a plurality of blade elements, each of the plurality of blade elements comprising a blade section; a tang section; a platform section connecting the blade section at a first end of the platform section and the tang section at a second end of the platform section, wherein the first and second ends of the platform transitions into the blade and the tang sections respectively; arranging each of the plurality of blade elements circumferentially about an axis, wherein the respective platform of each respective blade element overlaps the respective tang section of adjacent blade elements; and securing each of the plurality of blade elements between fore and aft wheels and fixing each of the plurality of blade elements to a respective adjacent blade element.

In some embodiments the plurality of blade elements are secured between the fore and aft wheels via the tang section being received in concentric grooves on opposing outer faces of the fore and aft wheels. In some embodiments the step of fixing each of the plurality of blade elements to a respective adjacent blade element comprises interlocking, adhesively bonding, welding or brazing the adjacent blade elements along an intersection of the first end of the platform of a blade element and the second end of the platform of an adjacent blade element. In some embodiments the steps of blanking and bending are performed simultaneous.

According to yet another aspect of the present disclosure, a pair of blade elements for a turbomachine comprise a first stamped blank formed into a first blade, a first platform, and a first tang; a second stamped blank formed into a second blade, a second platform, and a second tang. The first blade extends from a blade end of the first platform at approximately 90 degrees, and the first tang extends from a tang end of the first platform. The second blade extends from a blade end of the second platform at approximately 90 degrees, and the second tang extends from a tang end of the second platform. A top surface of the first tang is recessed from a top surface of the first platform by an amount equal to the thickness of the second platform, and the top surface of the first tang is shaped to seat a bottom surface of the second platform thereon. The radial distance from a center point to the top surface of the first platform is the same as the radial distance from the center point to a corresponding top surface of the second platform;

In some embodiments the first platform is secured to the second platform via an interlock, an adhesive bond, a weld, or a braze.

The present application discloses one or more of the features recited in the appended claims and/or the following features which, alone or in any combination, may comprise patentable subject matter.

BRIEF DESCRIPTION OF THE DRAWINGS

The following will be apparent from elements of the figures, which are provided for illustrative purposes and are not necessarily to scale.

Figure 2A:
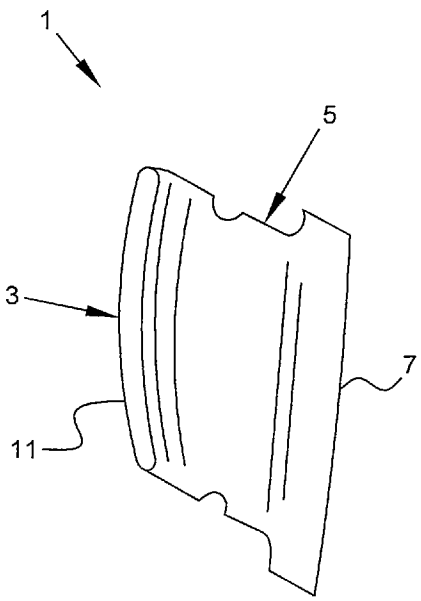
FIGS. 2*a-c* are top, front, and side views of a blade element in accordance with some embodiments of the present disclosure.

While the present disclosure is susceptible to various modifications and alternative forms, specific embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the disclosure as defined by the appended claims.

DETAILED DESCRIPTION

For the purposes of promoting an understanding of the principles of the disclosure, reference will now be made to a number of illustrative embodiments illustrated in the drawings and specific language will be used to describe the same.

This disclosure presents turbomachinery systems and methods of fabricating and assembling turbomachinery to achieve less expensive compressor or other turbomachine components than is currently available in the art. More specifically, the present disclosure describes a stamped blade for an axial flow or centrifugal compressor which comprises a hub having a plurality of blade elements arranged on the hub.

Stamping (also known as pressing) is the process of placing flat sheet metal in either blank or coil form into a stamping press where a tool and die surface forms the metal into a net shape. Stamping includes a variety of sheet-metal forming manufacturing processes, such as punching using a machine press or stamping press, blanking, embossing, bending, flanging, and coining. This could be a single stage operation where every stroke of the press produces the desired form on the sheet metal part, or could occur through a series of stages.

Figure 1:
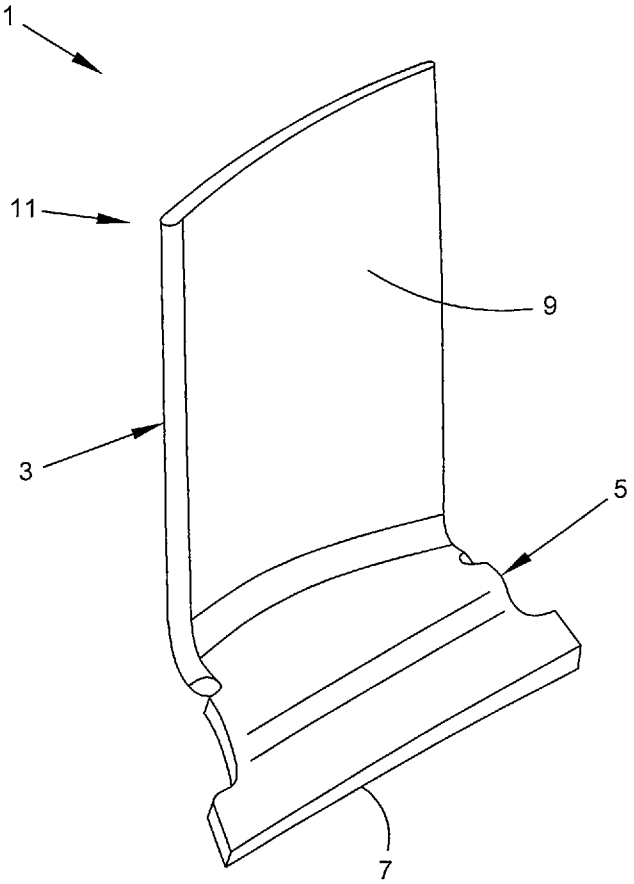
FIG. 1 is an isometric view of a blade element in accordance with an embodiment of the present disclosure.

A blade element 1 is illustrated in FIG. 1. The blade element 1 comprises a blade 3 and a platform 5 (or base). The platform 5 has a tang 7 extending from the platform 5. The blade element 1 is formed from a stamped blank and concurrently or subsequently bent into the desired form. As shown in FIG. 1, the platform 5 has a top surface and a bottom surface. The platform 5 transitions to the blade 3 at a first end and the tang 7 at a second end. The illustration in FIG. 1 depicts the blade platform 5 extending from the pressure side 9 of the blade 3. It is also possible that for some applications the platform 5 may extend from the suction side 11 of the blade 3, however extending from the pressure side 9 reduces radial loads between adjacent blade elements 1.

Figure 2C:
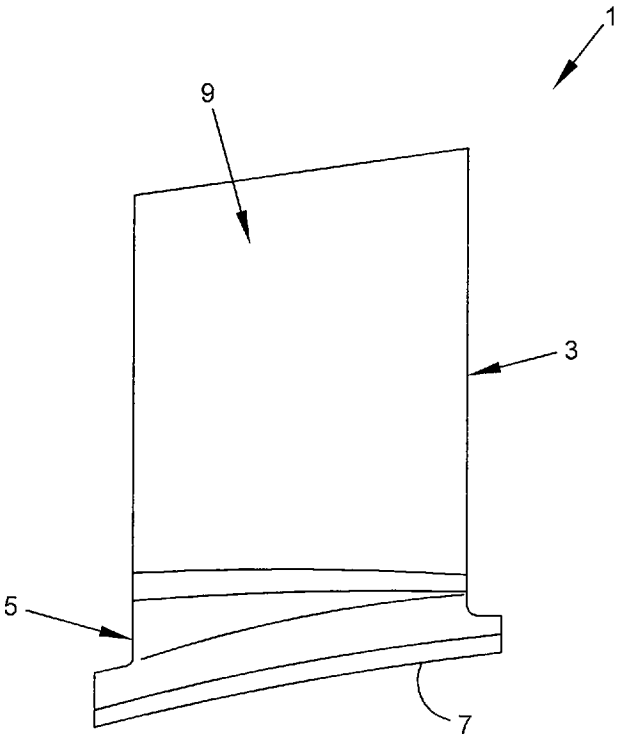
Figure 2B:
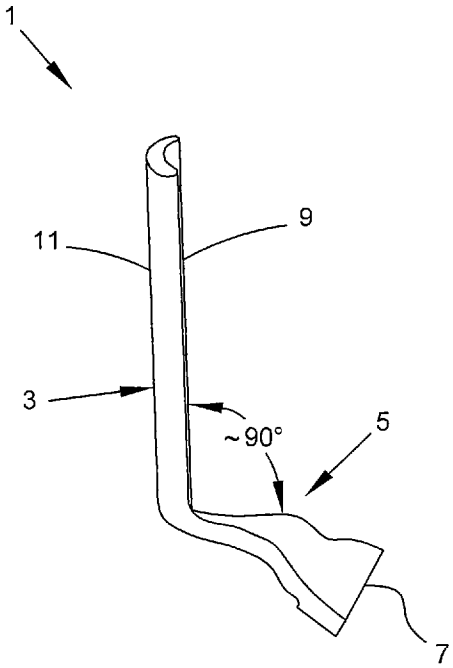

As shown in FIGS. 2*a-c*, the blade 3 extends from the platform 5 at the blade end forming approximately a 90° degree angle. The angle formed between the blade and the platform may also be obtuse or acute, but will generally not depart significantly from 90° degrees.

Figure 10:
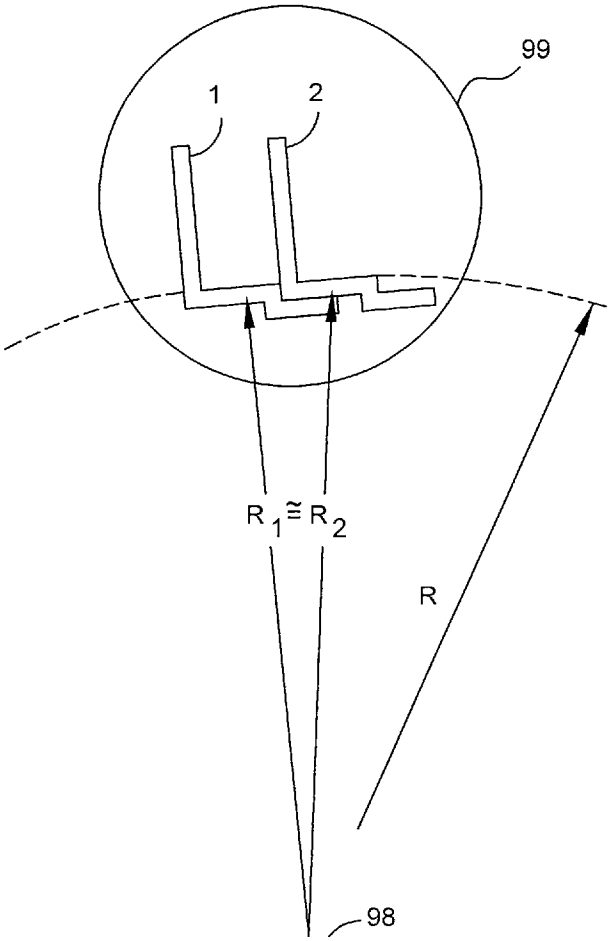
FIG. 10 is an illustration of a pair of blade elements oriented with respect to a center point.

The tang 7 as shown extends from the platform 5 on the tang end and is generally recessed from the platform 5 by the thickness of the platform 5 and shaped so as to receive the bottom platform surface of an identical blade element 2 (see FIGS. 4 and 10). The top surface of the tang 7 serves as a seat for an adjacent blade element 2. The tang 7 is shaped to receive the platform 5 of a second (adjacent) blade element 2 such that the respective top surfaces of the two platforms lie along the same circular arc, (e.g. are the same radial distance from a center point) as shown in FIG. 10.

Figure 3B:
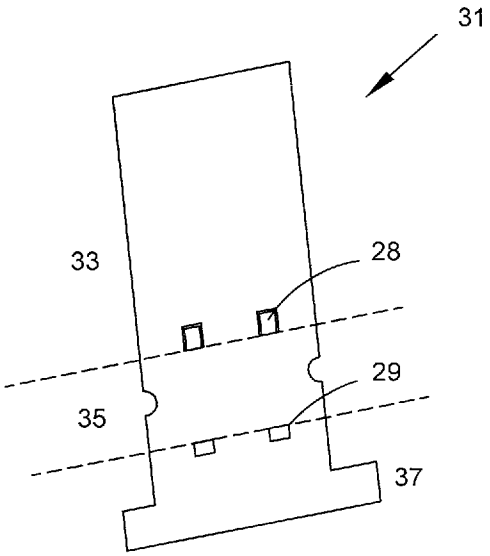
FIGS. 3*a-d* are illustrations of blanks from which embodiments of the blade element are formed in accordance with some embodiments of the present disclosure.
Figure 3A:
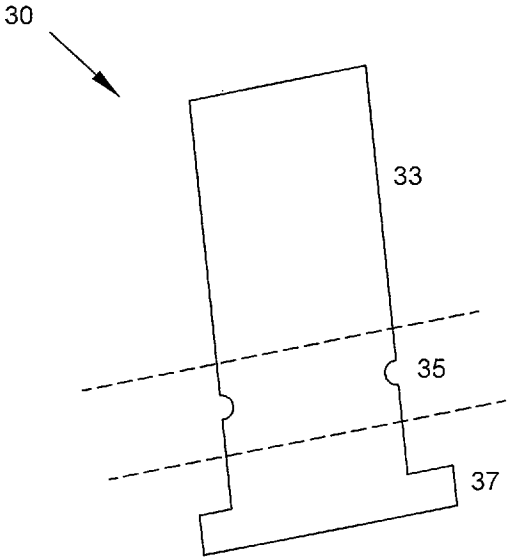
Figure 3D:
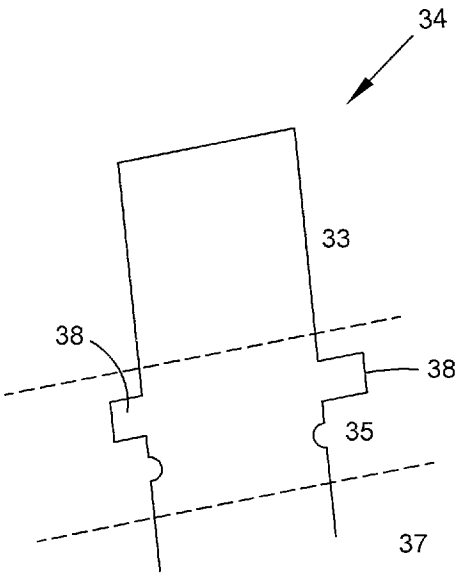
Figure 3C:
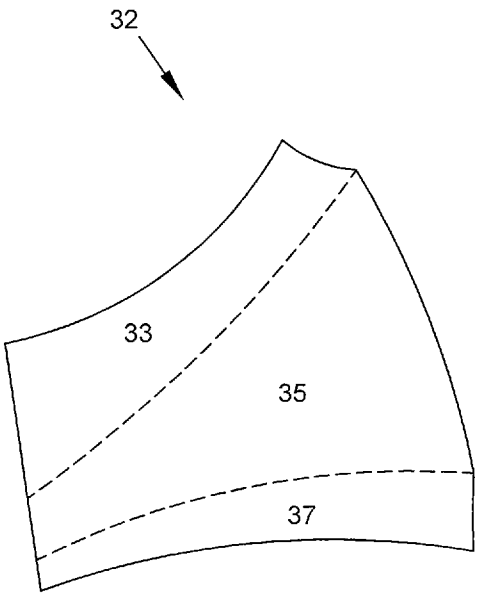

FIGS. 3*a-d* show examples of two dimensional blanks from which embodiments of the disclose subject matter are formed. In FIG. 3*a* the blank 30 is an example of the blade element 1 shown in FIGS. 1 and 2*a-c*. The blank 31 of FIG. 3*b* is an example of a blade element 1, which mechanically interlocks with an adjacent blade element. The blank 32 of FIG. 3*c* is an example of the blade element 1 shown in FIG. 7. with respect to a centrifugal compressor. The blank 34 of FIG. 3*d* is an example of blade element 1 in which the retention tabs 38 extend from the platform 35, rather than the tang 37, to engage with the fore and aft wheels 51 and 52 as described in FIG. 5. In FIGS. 3 *a-d*, the blade sections 33, platform sections 35 and tang sections 37 are shown without shaping. The stamping used to cut the blank from sheet metal and bending to shape the blade elements 1 may be performed simultaneous or sequentially. Absent shaping, the blanks have a constant thickness approximately equal to the thickness of the sheets formed therefrom.

Figure 5:
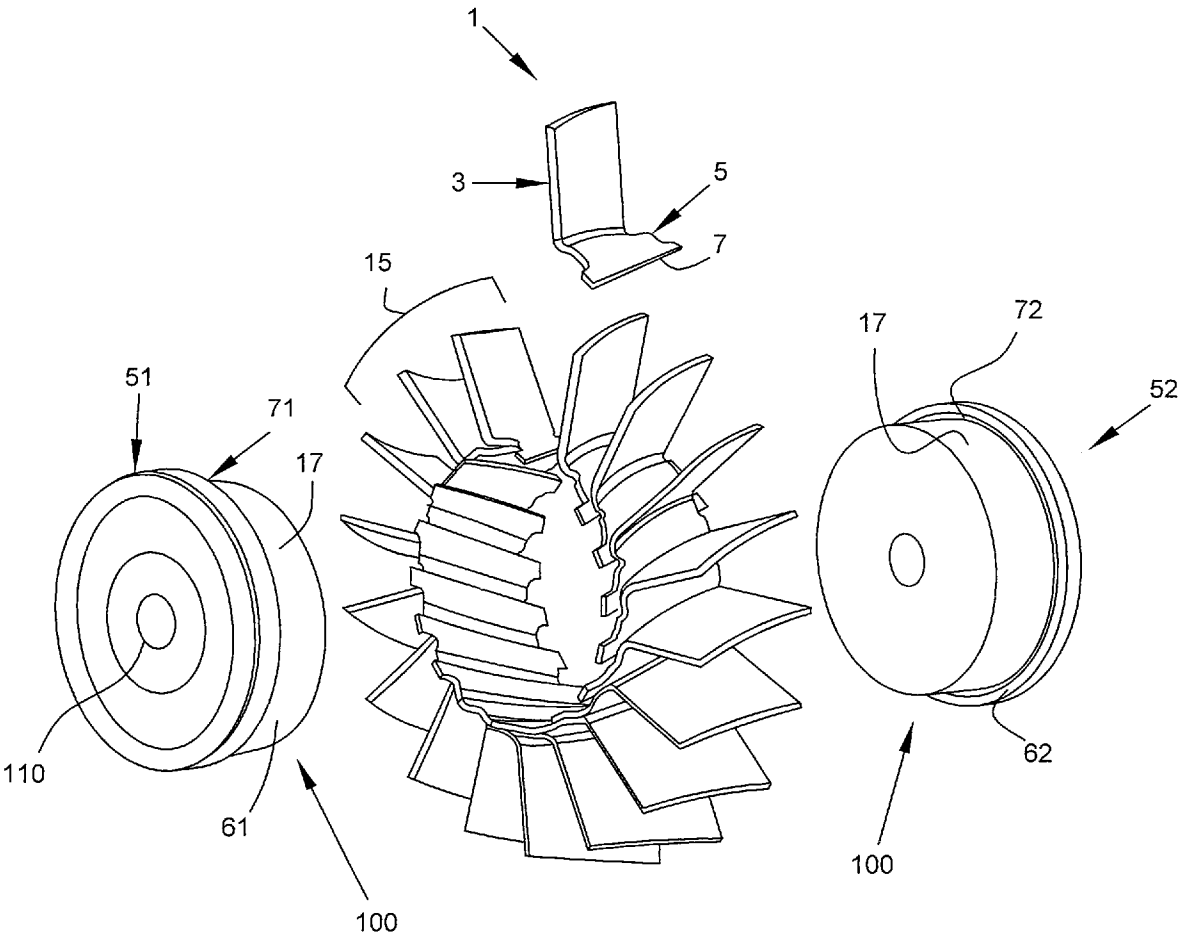
FIG. 5 is an isometric view of blade elements oriented with respect to fore and aft wheels of a hub in accordance with an embodiment of the disclosed subject matter.

Blade elements 15 may be arranged circumferentially around a hub 100 as shown in FIG. 5, with each of the platforms 5 of the respective blade elements 15 overlapping the tang 7 section of an adjacent blade element 1 and the blade elements 15 are retained in position between the fore 51 and aft 52 wheels by their engagement thereto, in addition to the attachment with the adjacent blade elements 1. The blade elements 15 abut a blade nesting surface 17 formed on the hub 100.

FIG. 5 illustrates an embodiment of the present subject matter in an axial compressor. It should be noted that although the current subject matter is described herein with respect to compressors, its use in turbines and other turbomachinery is equally envisioned. The hub 100 as shown in FIG. 5 may be comprised of a fore wheel 51 and an opposing aft wheel 52, the fore and aft wheels 51, 52 being co-axial with the axis of the compressor. The hub 100 has a bore 110 for receiving the shaft and a blade nesting surface 17. While in FIG. 5, the blade nesting surface 17 is distributed between the fore and aft wheels, it is equally envisioned the nesting surface may be entirely on one or the other, or a third sandwiched wheel (not shown).

In FIG. 5 each of the fore and aft wheels 51, 52 include opposing outer faces 61 and 62 with a slot or groove 71, 72 defined therein. The grooves 71, 72 receive the tangs 7 of the blade elements 15 and hold the blade elements 15 in place. The plurality of blade elements 15 are captured between two halves of the hub 100. These two halves may be identical. Retention of the two halves (fore and aft wheels 51, 52) may be accomplished by any number of methods. The hub 100 may be brazed, bolted together, retained through the use of a tie bolt. In the embodiment shown in FIG. 5 the blade elements 15 have tangs 7 extending forward and aft that are captured in grooves 71, 72 formed or machined into each wheel segment of the hub 100. The tangs 7 of the blade elements 15 extend axially beyond the platform 5 to engage the retaining grooves 71, 72 in the wheels 51, 52.

Figure 4D:
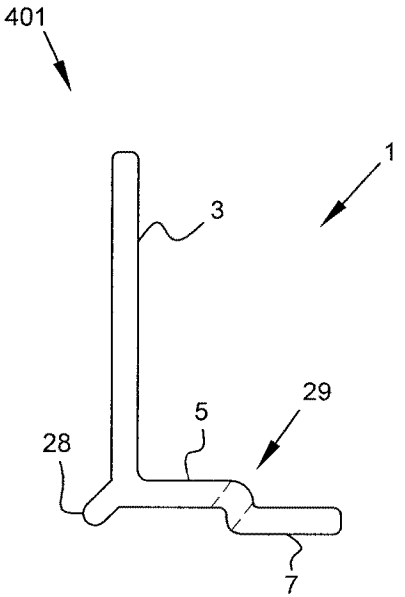
FIGS. 4*a-d* are illustrations of blade element interlocks according to embodiments of the disclosed subject matter.
Figure 4C:
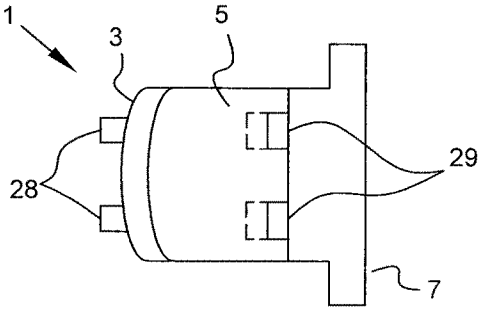
Figure 4B:
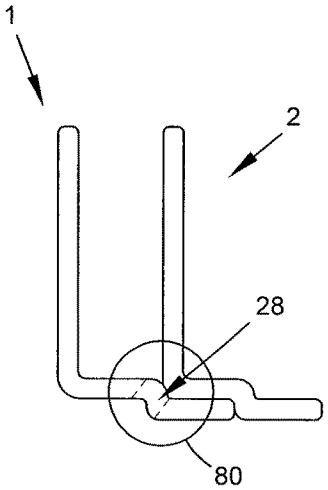
Figure 4A:
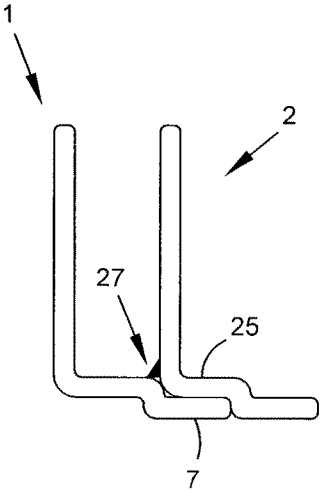

FIG. 4*a* shows a nested pair of blade elements, the first blade element 1 and the adjacent blade element 2. As shown in the cross section, the adjacent blade element's platform 25 overlaps and is seated upon the top surface of tang 7 of blade element 1. A bead 27 is welded or brazed to secure the pair to each other. As noted the pair may also be secured together mechanically or with an adhesive. While not shown, the platform may have additional tangs which further secure the blade element 1 within the groves 71 and 72 or additional grooves. Moreover, in other embodiments, for example as shown in FIG. 3*d* platform tangs 38 positioned laterally fore and aft of the platform 5 may be used in lieu of the fore and aft tangs shown in other embodiments. This latter embodiment may not require additional securing methods between the blade elements.

FIG. 4*b* shows blade element 1 and adjacent blade element 2 nested together and mechanically fixed by the insertion of tab 28 of blade element 2 into the notch 29 of blade element 1. In FIG. 4*b*, a cross sectional view of a blade element 1 in which the blade element 1 is fixed or attached to an adjacent blade element 2 via an interlock 80. FIG. 3*b* shows a slot or notch 29 punched or stamped in the second end of the platform 5 for receiving a corresponding tab 28 extending from the platform 5 of the adjacent blade element 2, or visa versa. This interlock 80 prevents radial movement of the blade element 1 by transferring the load at the adjacent blade element 2 to the tang 7 of the blade element 1.

FIGS. 4*c* and 4*d* are top and sideview of embodiments of blade elements 1 using mechanical interlocks as shown in FIG. 4*b*.

Figure 6:
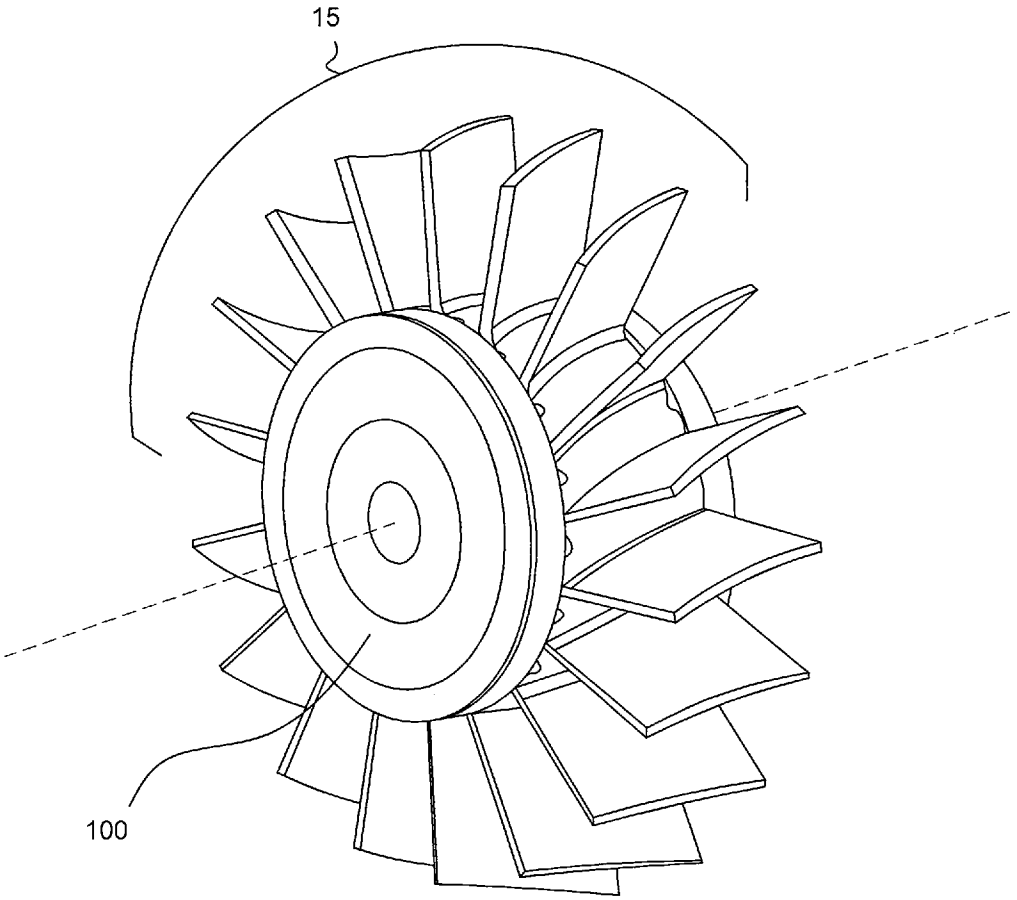
FIG. 6 is an isometric view of an assembled hub in accordance with an embodiment of the disclosed subject matter.

FIG. 6 presents an isometric view of a plurality of blade elements 15 arranged on the assembled hub 100 in accordance with some embodiments of the disclosed subject matter.

The hub 100 may have various shapes including but not limited to the shape of a cone, conical frustum, cylinder, zone, paraboloid, hyperboloid or semi-spheroid. The shape of the hub 100 would typically be a function of the blade element 1, the flow path of the working fluid, and the shaft to which the compressor attaches.

The hub 100 is adapted to be rotatable about an axis passing therethrough. Hub 100 may be hollow having a tubular structure. For example the hub may be a nose cone and thus of conical or paraboloid shape. In some embodiments hub 100 is formed from metal or a metal-based compound or alloy. The hub 100 may also be assembled from numerous hub segments as previously noted.

Figure 7:
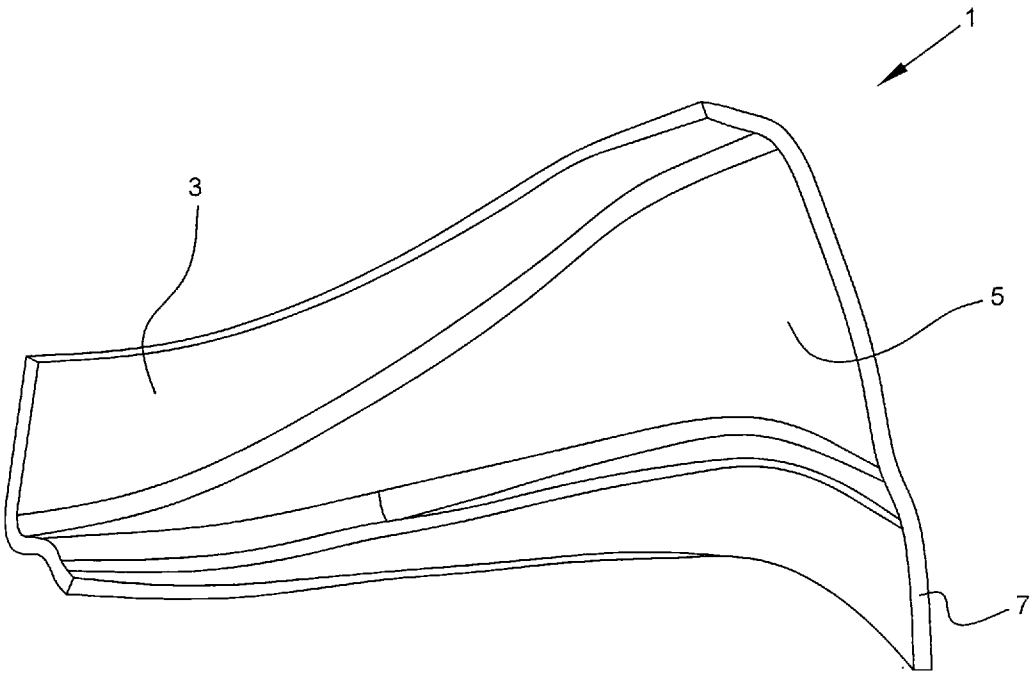
FIG. 7 is an isometric view of a centrifugal blade element in accordance with an embodiment of the present disclosure.

Another embodiment of the current subject matter includes a centrifugal compressor. FIG. 7 shows an embodiment of a blade element for a centrifugal compressor. The blade element 1, as described previously, is formed from a stamped blank, includes a blade 3, platform 5 and tang 7. In the centrifugal compressor embodiment, the tang 7 does not extend axially beyond the platform, as described in one embodiment of a blade element 1 for an axial compressor.

Figure 8:
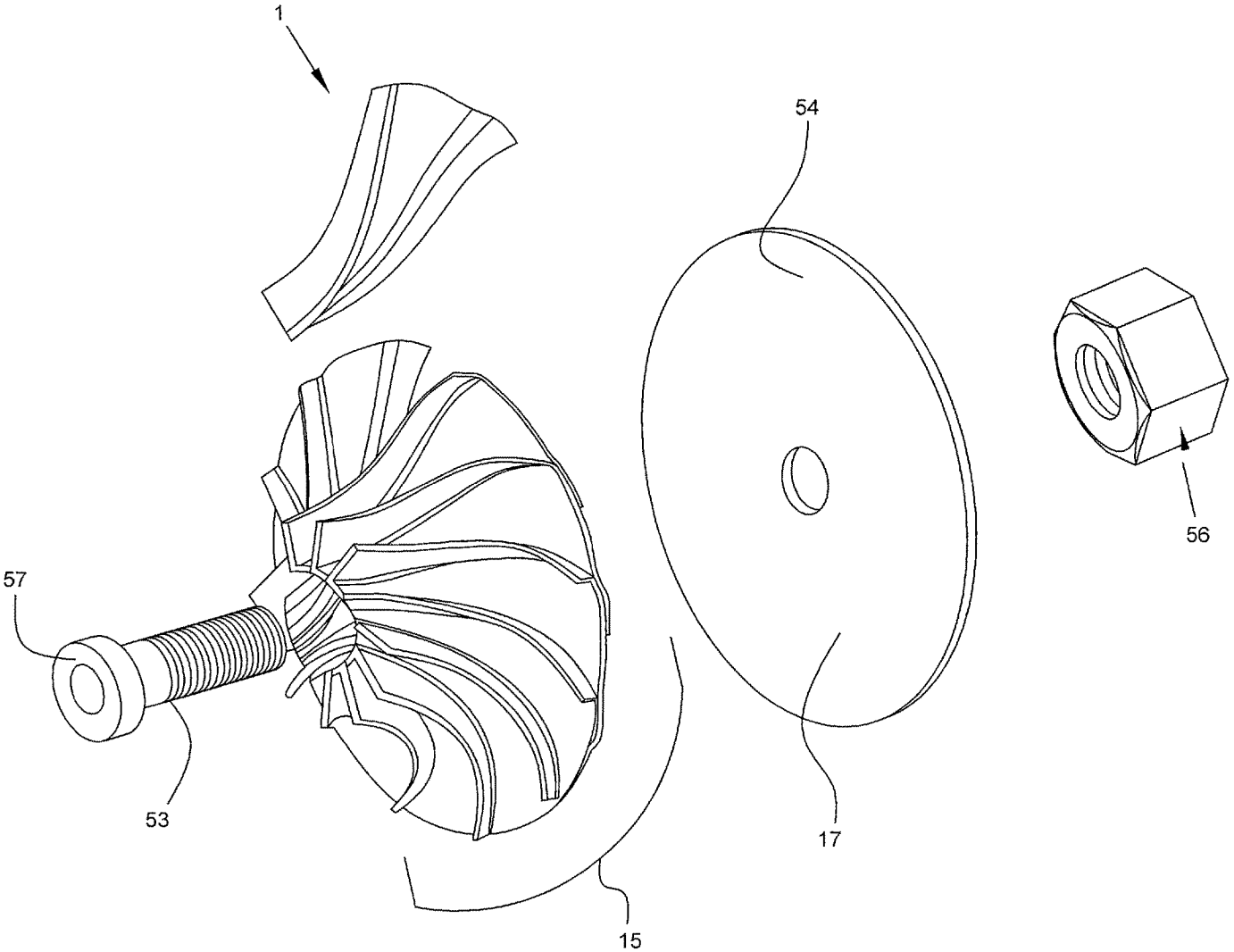
FIG. 8 is an isometric view of blade elements in a centrifugal compressor oriented with respect to fore and aft wheels of a hub in accordance with an embodiment of the disclosed subject matter.

FIG. 8 shows an exploded view of the assembly of the blade elements 15 and hub 100. The hub 100 in the embodiment illustrated in FIG. 8 is formed of a forward spindle 53 and aft wheel or disc 54. The blade nesting surface 17 is shown on aft wheel 54, as well as on the spindle 53. The spindle 53 and disc 54 may be connected with adhesives, welding, brazing or as shown in FIG. 8 with a nut 56. The blade elements 15 are sandwiched between a flange 57 on the front of the spindle 53 and the aft disc 54.

Figure 9:
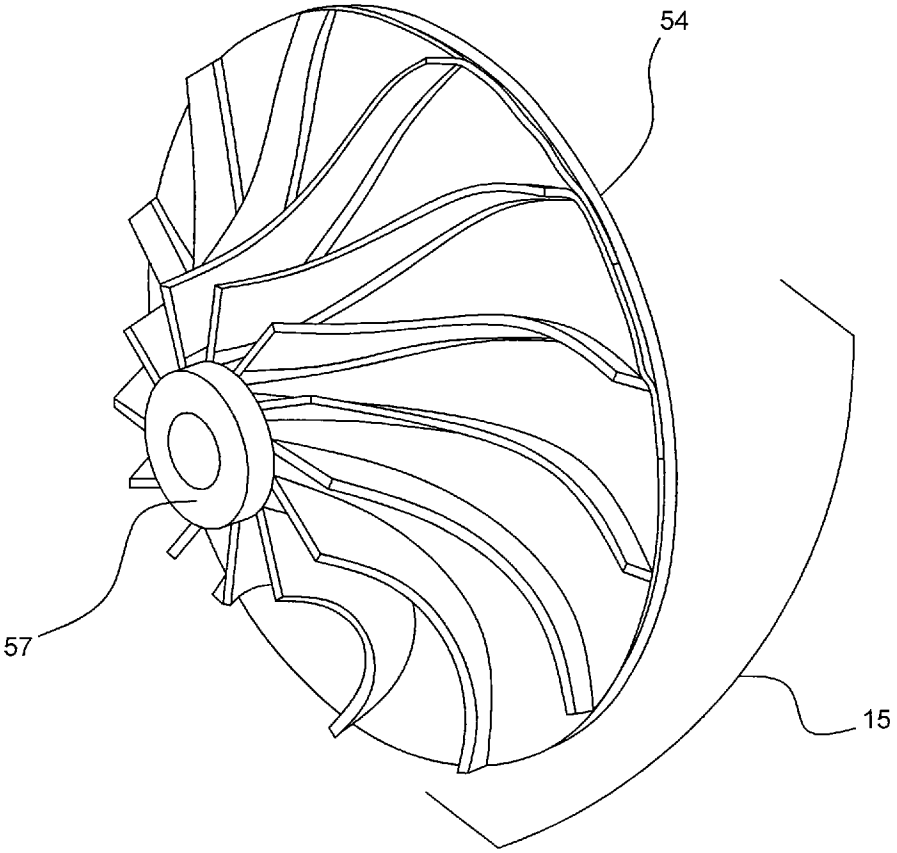
FIG. 9 is an isometric view of an assembled hub of a centrifugal compressor in accordance with an embodiment of the disclosed subject matter.

FIG. 9 presents an isometric view of the assembled centrifugal compressor in accordance with embodiments of the present subject matter.

In the embodiments described above the platform 5 and blade 3 and tang 7 are integrally formed as a single component from a single blank. However, it is envisioned that the blade elements 1 may also be formed from more than one stamped pieces welded or brazed together, or a plurality of blanks assembled and subsequently stamped.

The bottom surface of the tang 7, or radially-inward facing surface of the tang 7 may be beneficially contoured to match or substantially conform to the blade nesting surface 17 of hub 100.

In some embodiments, blade 3 or blade element 1 may further be coated with a protective material. For example, to protect the exposed areas, specifically the blade 3 and top surface of the platform 5 of the blade element 1 from oxidation encouraged by the elevated temperature, these components may be coated with Nanovate™. Nanovate is an electrodeposited (plated) nanocrystalline metal.

The blade elements 1 may be coupled to hub 100 using mechanical interlocks, bolts, brazing, welding, adhesive, glue, epoxy, or similar material. The adhesive may be applied to the bottom of the tang 7, top of the tang 7, bottom of the platform 5 and/or side surfaces of each blade element 1 in order to couple each blade element 1 both to the hub 100 and to adjacent blade elements 2. In some embodiments the adhesive is necessary only to hold blade element 1 to hub 100 while blade elements 1 and hub 100 are assembled.

In some embodiments the assembly may be used in conjunction with additional assemblies which may be arranged in stages. The stages may be arranged or spaced to provide a gap for stator vanes between each assembly. In some embodiments spacers may separate the stages.

In some embodiments blade elements 1 may be arranged on hub 100 substantially parallel to the axis of rotation. In other embodiments blade elements 1 may be arranged on hub 100 at an angle relative to the axis of rotation of the shaft (not shown). Once the compressor is assembled as described above, it may be coupled to a rotatable shaft.

FIG. 10 illustrates a pair 98 of blade elements (blade element 1 and adjacent blade element 2) arranged along a circular arc with a center point. The pair having a corresponding upper surface of the platform 5 which are an equal distance from the center point 98 or axis of rotation. While the top surface of the platform 5 need not be co-axial with the center point or the adjacent platform surface, corresponding locations, such a midpoint of the respective platforms (as shown in FIG. 10) should be equal distance from the axis 98.

The disclosed turbomachinary as described above has numerous and varied applications in the field of fluid compression and expansion. Such applications include, but are not limited to, aviation applications such as gas turbine engines for aircraft and unmanned aerial vehicles (UAVs), expendable compressor applications such as for missile propulsion systems, land- and sea-based gas turbine engines providing electrical generation and/or propulsion, and any rotating machinery generally. Likewise, other turbomachineary, such as turbines, vanes and centrifugal compressors are also envisioned being arranged in accordance with this disclosure.

The present disclosure provides many advantages over previous compressors. By constructing a rotatable element entirely or partially from stamped rather than machined materials, the rotatable element achieves a significant reduction in cost and speed of manufacture. Particularly for aviation application, this cost and time reduction provides a substantial advantage over prior art compressors fabricated extensively from machined metals and metal-based materials. The use of traditional materials when fabricating the compressor may additionally lead to a cost savings due to lower prices of raw materials used in the compressor. Additional cost savings may be achieved through the reduction or elimination of numerous fasteners, discs, and seal assemblies currently required in advanced compressor designs. Finally, yet further cost savings may be achieved by faster and more simple manufacturing processes which are afforded by the rotatable element presently disclosed.

Although examples are illustrated and described herein, embodiments are nevertheless not limited to the details shown, since various modifications and structural changes may be made therein by those of ordinary skill within the scope and range of equivalents of the claims.

What is claimed is:

1. A turbomachine comprising:

a hub comprised of a fore wheel and an opposing aft wheel, the fore and aft wheels being co-axial, the hub having a bore coaxial with the fore and aft wheels and a blade nesting surface;

a plurality of blade elements, each one of the plurality of blades elements formed from a stamped blank and comprising:

a blade section;

a tang section;

a platform section connecting the blade section at a first end of the platform section and the tang section at a second end of the platform section, wherein the first and second ends of the platform transitions into the blade and the tang sections respectively;

wherein the plurality of blade elements are arranged circumferentially around the hub, each platform section of respective blade elements overlapping the tang section of an adjacent blade element and retained in position between the fore and aft wheel by an engagement with the fore and aft wheel and attachment with the adjacent blade, wherein each blade element abuts the blade nesting surface of the hub.

2. The turbomachine of claim 1, wherein the turbomachine is an axial compressor.

3. The turbomachine of claim 2, wherein the fore wheel abuts the aft wheel on opposing inner faces.

4. The turbomachine of claim 3, wherein the tang sections of each of the plurality of blade elements extend axially beyond the platform section and are received in co-axial slots on opposing outer faces of the respective wheels.

5. The turbomachine of claim 2, wherein the blade nesting surface is normal to the radial direction.

6. The turbomachine of claim 2, wherein the hub has a shape selected from the group consisting of cone, conical frustum, cylinder, zone, paraboloid, hyperboloid and semi-spheroid.

7. The turbomachine of claim 2, further comprising a slot and a tab, the slot in a platform section proximate the second end for receiving a corresponding tab on an adjacent platform section proximate the first end of an adjacent blade element.

8. The turbomachine of claim 1, wherein a second tang section extends axially forward and aft from an overlapping portion of each blade platform section proximate the second end.

9. The turbomachine of claim 1, wherein the plurality of blade elements are stamped from a sheet of metal or metal alloy.

10. The turbomachine of claim 1, wherein the attachment with the adjacent blade is selected from the group consisting of an interlock, an adhesive bond, a weld, and a braze.

11. The turbomachine of claim 9, wherein the sheet is a sheet of high carbon steel or nickel alloy.

12. The turbomachine of claim 1, wherein the turbomachine is a centrifugal compressor.

13. The turbomachine of claim 12, wherein the blade nesting surface is normal to the axial direction.

14. The turbomachine of claim 12, wherein the aft wheel is a disc and the fore wheel is a spindle.

15. A method of manufacturing a bladed hub of a turbomachine comprising:

blanking blanks from a sheet of metal or metal alloy;

bending the blanks to form a plurality of blade elements, each of the plurality of blade elements comprising:

a blade section;

a tang section;

a platform section connecting the blade section at a first end of the platform section and the tang section at a second end of the platform section, wherein the first and second ends of the platform transitions into the blade and the tang sections respectively;

arranging each of the plurality of blade elements circumferentially about an axis, wherein the platform section of each respective blade element overlaps the respective tang section of an adjacent blade element;

securing each of the plurality of blade elements between fore and aft wheels and fixing each of the plurality of blade elements to a respective adjacent blade element.

16. The method of claim 15, wherein the plurality of blade elements are secured between the fore and aft wheels via the tang sections being received in concentric grooves on opposing outer faces of the fore and aft wheels.

17. The method of claim 15, wherein the step of fixing each of the plurality of blade elements to a respective adjacent blade element comprises interlocking, adhesively bonding, welding or brazing the adjacent blade elements along an intersection of the first end of the platform section of a blade element and the second end of the platform section of an adjacent blade element.

18. The method of claim 15, wherein the steps of blanking and bending are performed simultaneously.

19. A pair of blade elements for a turbomachine comprising;

a first stamped blank formed into:

a first blade;

a first platform; and a first tang, a second stamped blank formed into:

a second blade;

a second platform; and a second tang;

the first blade extending from a blade end of the first platform at 90 degrees, and the first tang extending from a tang end of the first platform;

the second blade extending from a blade end of the second platform at 90 degrees, and the second tang extending from a tang end of the second platform;

wherein a top surface of the first tang is recessed from a top surface of the first platform by an amount equal to a thickness of the second platform, and the top surface of the first tang is shaped to seat a bottom surface of the second platform thereon;

wherein a radial distance from a center point to the top surface of the first platform is the same as a radial distance from the center point to a corresponding top surface of the second platform.

20. The pair of blade elements of claim 19 wherein the first platform is secured to the second platform via an interlock, an adhesive bond, a weld, or a braze.

* * * * *